US009777571B2

(12) United States Patent
Davidson et al.

(10) Patent No.: US 9,777,571 B2
(45) Date of Patent: Oct. 3, 2017

(54) METHOD FOR DETERMINING REGIONS FOR STIMULATION ALONG TWO PARALLEL ADJACENT WELLBORES IN A HYDROCARBON FORMATION

(71) Applicants: Husky Oil Operations Limited, Calgary (CA); Wavefront Technology Solutions Inc., Edmonton (CA)

(72) Inventors: Brett C. Davidson, Edmonton (CA); Lawrence J. Frederick, Calgary (CA); Tor Meling, Edmonton (CA)

(73) Assignees: Husky Oil Operations Limited, Calgary, AB (CA); Wavefront Technology Solutions Inc., Edmonton, AB (CA)

( * ) Notice: Subject to any disclaimer, the term of this patent is extended or adjusted under 35 U.S.C. 154(b) by 666 days.

(21) Appl. No.: 14/029,718

(22) Filed: Sep. 17, 2013

(65) Prior Publication Data

US 2015/0075775 A1 Mar. 19, 2015

(51) Int. Cl.

| | |
|---|---|
| ***E21B 49/00*** | (2006.01) |
| ***E21B 43/26*** | (2006.01) |
| ***E21B 28/00*** | (2006.01) |
| ***E21B 34/08*** | (2006.01) |
| ***E21B 43/00*** | (2006.01) |
| ***E21B 43/24*** | (2006.01) |

(52) U.S. Cl.

CPC ..... *E21B 49/008* (2013.01); *E21B 28/00* (2013.01); *E21B 34/08* (2013.01); *E21B 43/003* (2013.01); *E21B 43/2408* (2013.01); *E21B 43/26* (2013.01)

(58) Field of Classification Search

None

See application file for complete search history.

(56) References Cited

U.S. PATENT DOCUMENTS

| | | | |
|---|---|---|---|
| 4,099,563 | A | 7/1978 | Hutchison et al. |
| 4,993,678 | A | 2/1991 | Easter |
| 5,048,611 | A | 9/1991 | Cochran |

(Continued)

*Primary Examiner* — Caroline N Butcher

(74) *Attorney, Agent, or Firm* — Frost Brown Todd LLC

(57) ABSTRACT

A method for determining along relatively uniformly spaced apart parallel first and second wellbores situated in an underground hydrocarbon-containing formation, regions within the formation, including in particular regions between such wellbores, to inject a fluid at a pressure above formation dilation pressure, to stimulate production of oil into the second of the two wellbores, and subsequently injecting fluid at pressures above formation dilation pressures at the discrete regions along such wellbores determined to be in need. An initial information-gathering procedure is conducted, wherein fluid is supplied under a pressure less than formation dilation or fracture pressure, to discrete intervals along a first wellbore, and sensors in the second wellbore measure and data is recorded regarding the ease of penetration of such fluid into the various regions of the formation intermediate the two wellbores. Regions of the formation exhibiting poor ease of fluid penetration are thereafter selected for subsequent dilation, at pressures above formation dilation pressures. Where initial fluid pressures and/or formation dilation pressures are provided in cyclic pulses, a downhole tool is disclosed for such purpose.

24 Claims, 13 Drawing Sheets

(56) References Cited

U.S. PATENT DOCUMENTS

| | | | | |
|---|---|---|---|---|
| 5,836,393 | A * | 11/1998 | Johnson | E21B 28/00 166/177.5 |
| 6,851,473 | B2 * | 2/2005 | Davidson | B01J 8/02 166/169 |
| 7,405,998 | B2 | 7/2008 | Webb et al. | |
| 7,543,634 | B2 | 6/2009 | Fehr et al. | |
| 7,806,184 | B2 | 10/2010 | Schultz et al. | |
| 7,832,472 | B2 | 11/2010 | Themig | |
| 8,061,421 | B2 * | 11/2011 | Samaroo | E21B 28/00 166/177.5 |
| 8,567,505 | B2 * | 10/2013 | Davidson | E21B 43/003 166/305.1 |
| 2011/0048724 | A1 * | 3/2011 | Pringle | E21B 43/25 166/320 |
| 2011/0229071 | A1 * | 9/2011 | Vincelette | E21B 43/2406 385/13 |
| 2012/0160524 | A1 * | 6/2012 | Lumbye | E21B 33/1243 166/387 |
| 2014/0000886 | A1 * | 1/2014 | Milam | E21B 43/16 166/272.3 |

* cited by examiner

METHOD FOR DETERMINING REGIONS FOR STIMULATION ALONG TWO PARALLEL ADJACENT WELLBORES IN A HYDROCARBON FORMATION

FIELD OF THE INVENTION

The present invention relates to a method for stimulating a hydrocarbon-containing formation prior to recovery using SAGD or cyclic steam stimulation (CSS).

BACKGROUND OF THE INVENTION

Fracturing of an underground hydrocarbon formation along a wellbore extending through the formation by injection of pressurized fluids into the formation via the wellbore have been used for a number of years.

Specifically, injection of pressurized fluids in hydrocarbon formations at pressures above formation dilation pressures has been used in the past to provide fractures and fissures in rock surrounding a wellbore, to thereby stimulate a reservoir to release oil therein by providing channels within the fractured rock which oil the formation may then flow through to then be collected.

The fracturing fluid which is provided under pressure may be a non-compressible fluid such as water, and/or further containing proppants and/or hydrocarbon diluents for the purpose of not only creating fissures in the rock but for further propping and maintaining the fissures in an open position to allow oil to flow through and/or reduce the viscosity of the oil and cause it to more readily flow through created fissures in the rock.

Disadvantageously, however, in hydrocarbon formations where the characteristics of the formation may not be completely understood or known at all locations in the formation, injection of pressurized fluids along an entire length of a wellbore may inadvertently inject liquids into regions of the formation where the porosity of the formation at certain regions may already be such that such is not needed, or are locations containing relatively less hydrocarbons, which in either case such is wasteful of the injected fluid. This is particularly of concern in instances around the world where water, which is typically a principal component of the injected fluid, is scarce, difficult to obtain, or not available.

Also disadvantageously, hydrocarbon reservoirs often possess regions of high water content. Fracturing along an entirety of the length of a wellbore and thus in all regions of a formation bounding a wellbore will typically undesirably result in fracturing of rock in one or more high water content regions. Such fracturing thereby allows water therein to more easily flow out of such regions and into the wellbore, and conversely allows oil to flow into these regions when water has vacated, thereby detrimentally affecting recovery of hydrocarbons through the wellbore.

Accordingly, for the above reasons, indiscriminate fracturing along a wellbore, without having intimate knowledge of the in situ geology and in particular the porosity of the formation directly in the region of the wellbore often leads to reduced recovery from the formation via that wellbore that would otherwise be the case if the porosity and "tightness" of the oil at various discrete locations along the wellbore was otherwise known.

Accordingly, a real need exists in the oil recovery industry of an in-situ method to allow reservoir and production engineers to better understand, for a particular reservoir, the geology and porosity of the formation in regions bordering the wellbore, and in particular which regions of a formation immediately adjacent such wellbore may be "tight" and thus where oil is potentially trapped and which are in need of stimulation through fracturing and/or injection of proppants and/or diluents, as distinguished from other regions of the formation along a wellbore which are not as "tight" and for which injection of fluids into such regions may not produce as much benefit and/or stimulation thereof which may prove detrimental to oil recovery.

As regards downhole tools for injecting fluid under high pressures as commonly used for conducting fracturing operations, such tools have likewise been known and used for a number of years. More recently, however, downhole tools have been developed which provide high pressure cyclic pressure surges, instead of a single high pressure, which is more effective in providing stimulation as it avoids constant high pressure application to the formation which might otherwise displace oil from the region of the wellbore and/or negatively affect the created fissures.

Examples of recent downhole tools which provide pulses of pressurized fluid at pressures in excess of formation dilation pressures to propagate pressure waves through a formation are tools/valves such as those described in U.S. Pat. No. 7,806,184 entitled "Fluid Operated Well Tool" and U.S. Pat. No. 7,405,998 entitled "Method and Apparatus for Generating Fluid Pressure Pulses", each of said patents commonly assigned to one of the a co-assignees of the within invention.

SUMMARY OF THE INVENTION

As used herein, and within the claims, the term "stimulation" or "stimulation" of a well or wellbore is intended to mean, and is defined as including not only fracturing a formation by injection of pressurized fluids, such as water, proppants, and the like, but also includes dilation or any stimulation whereby any fluids, including gases or combinations thereof, are injected for the purpose of changing the absolute or relative permeability of the formation.

As also used herein and within the claims, the term oil is intended to include, and is defined as including all hydrocarbons.

As also used herein and within the claims, the term "wellbore" shall mean any borehole within a hydrocarbon formation, either an uncased wellbore or a wellbore cased with a perforated or porous casing.

In order to avoid the aforesaid problems with prior art fracturing and stimulation techniques which apply indiscriminate fracturing by applying fluid pressure along a wellbore at a pressure above the rock fracture pressure, and to instead provide for customized (ie optimized) stimulation of a formation for subsequent SAGD or CSS operation to regions where stimulation will be best put to use, the invention in a first broad embodiment thereof provides for a pre-stimulation information gathering method which allows for an in-situ determination of relative reservoir properties of regions of the formation bordering a pair of wellbores, prior to conducting formation dilation by injection of pressurized fluid in excess of formation dilation pressure.

Such pre-stimulation "information gathering" method advantageously allows determination or inference of relative porosities, permeabilities, relative permeabilities, and fluid saturations and geology of such regions and provides valuable quantitative information as to the relative ease of penetration of fluids in such regions of the formation by subjecting various discrete intervals along the length of a collection wellbore to a pressurized fluid at a pressure less than formation dilation pressure and/or fracturing pressure. Such determination or inference of the relative nature of these properties along the length of the well is used in subsequent steps of determining the optimal well stimulation strategy. Analysis of the ease of penetration of such fluid into the formation at each of the discrete intervals along the wellbores, and in particular determining regions of the formation which are "tight" and in particular are resistant to fluid penetration allows determination of regions along the wellbore which would benefit best from subsequent stimulation, namely injection of a pressurized fluid at a pressure greater than formation dilation pressure or rock fracture pressure in such regions, to thereby best utilize such stimulation method in the regions of the wellbore which will best benefit from stimulation, and avoid use in regions for which stimulation would not be as beneficial, or would be detrimental.

Accordingly, in a first broad aspect of this invention such comprises a method of determining, along a length of two parallel mutually adjacent wellbores situated in an underground hydrocarbon-containing formation, discrete regions in said formation along said two wellbores where injection of a fluid into the formation may be more necessary as compared to various other regions along said two wellbores for stimulating production of oil, comprising the steps of:

(ii) applying, via fluid pressurization means, a fluid at a first pressure below formation dilation pressure, at a plurality of discrete intervals along said first wellbore; and (iii) sensing, via sensing means situated in a second wellbore of said two wellbores, at a similar plurality of discrete intervals situated along a length of said second wellbore, a value or values indicative of ease of penetration of said fluid or magnitude of a pressure pulse of said fluid from said first wellbore to said second wellbore, and compiling a plurality of values at said associated discrete locations along said wellbores.

The fluid pressurization means may be a tool/valve situated at surface, wherein pressurized fluid is pumped downhole, or alternatively may be a tool/valve which may be situated downhole in the wellbore, each of which may further be adapted to apply cyclic pressure pulses. In an embodiment of the method where a single downhole tool/valve is used, such downhole tool/valve may be moved within the wellbore to successive discrete locations along the wellbore, and fluid pressure pulses provided at each of such discrete intervals (at fluid pressures below formation dilation pressure), in order to acquire the desired information regarding ease of fluid penetration at each of the discrete intervals along the wellbore.

Alternatively, in another embodiment of using downhole fluid pressurization means, a plurality of downhole tools/valves are located downhole, at a plurality of discrete intervals along a length of the wellbore. Fluid pressure is then supplied simultaneously to each of such downhole tools/valves, in order to simultaneously acquire the desired information regarding ease of fluid penetration at each of the discrete intervals along the wellbore. This refinement method has the advantage of allowing for rapidly determining the regions within the formation for subsequent optimal stimulation. The tubing and associated downhole tools and packer elements are then removed from the wellbore, and fluid pressurization means then inserted downhole to fracture the formation at only those locations where stimulation was determined to be potentially beneficial from the previous information-gathering step. Alternatively, if such downhole tools/valves are not removed from the wellbore and left therein, such requires those tools that are located in regions determined not to be beneficial for subsequent stimulation, to be controlled in a manner, such as by further having pressure-actuated sleeves or ball-actuated valves as disclosed in any one of U.S. Pat. No. 4,099,563, U.S. Pat. No. 4,993,678, U.S. Pat. No. 5,048,611, U.S. Pat. No. 7,543,634, or U.S. Pat. No. 7,832,472 located in such tubing to be used at each of the various discrete intervals. Such additional sleeves or valves then serve to prevent each downhole tool/valve from supplying high pressure fluid to the formation during the subsequent stimulation operation to regions where it has been determined that stimulation would not be beneficial.

In a further broad aspect of the invention, such comprises a method of determining, along a length of two parallel mutually adjacent wellbores situated in an underground hydrocarbon-containing formation, discrete regions in said formation along and intermediate said two wellbores where injection of a fluid into the formation may be more necessary as compared to various other regions along said two wellbores intermediate said two wellbores for stimulating production of oil, comprising the steps of:

(i) placing within a first of said two parallel wellbores, at a plurality of discrete intervals along a length thereof, fluid pressurization means for supply of a pressurized fluid at each of said discrete intervals along said first wellbore;

(ii) applying, via said fluid pressurization means, said fluid at a first pressure below formation dilation pressure, at said plurality of discrete intervals along said first wellbore; and (iii) sensing, via sensing means situated in a second wellbore of said two wellbores, at a similar plurality of discrete intervals situated along a length of said second wellbore, a value or values indicative of ease of penetration of said fluid or magnitude of a pressure pulse of said fluid from said first wellbore to said second wellbore, and compiling a plurality of values at said associated discrete locations along said wellbores.

In a preferred embodiment, such method further comprises a step (iv) of using the values associated with the discrete intervals as determined in step (iii) to determine regions along and/or between said wellbores indicative of having difficulty of penetration of said fluid or a pressure pulse of said fluid, to thereby determine those regions along the wellbores where formation dilation, fracturing, stimulation, or injection of a fluid would potentially be desirable.

The sensors which provide values indicative of ease or difficulty of fluid penetration at a corresponding discrete region along the wellbore may, to fulfil this requirement, in one embodiment simply sense and transmit to surface a value indicative of a magnitude of said pressure pulse resulting from supply of said pressurized fluid at said corresponding discrete intervals in said first wellbore. Similar values are obtained from other sensors situated at similar discrete intervals along the second wellbore when the fluid pressure supply tool situated at corresponding discrete intervals likewise supplies a fluid pressure pulse at each of such intervals. Thereafter, these values are used to determine regions along and/or between said wellbores having the lowest value which is indicative of the difficulty at such discrete locations in providing fluid penetration at such location, to determine those regions along the wellbores where fracturing, formation dilation, stimulation, or injection of a fluid would potentially be desirable.

Alternatively, the sensors may, in an alternative embodiment, provide a value or values indicative of rate of, volume of, or whether penetration of, fluid penetration from said first wellbore to said second wellbore resulting from supply of said pressurized fluid at said discrete regions in said first wellbore, and thereby compiling a plurality of values at said associated discrete locations along said wellbores; and such values then used to determine regions along and/or between said wellbores indicative of regions along the wellbores where fracturing, formation dilation, stimulation or injection of a fluid would potentially be desirable.

Specifically, the sensors may act in any of the following manners, namely by:

(i) sensing a value indicative of a rate of pressure decline from a fixed initial pressure of said fluid supplied via said fluid pressurization means; or (ii) sensing a value indicative of a volume of fluid supplied via said fluid pressurization means during a given time interval;

(iii) sensing a value indicative of a quantum of pressure decline over a given time interval with respect to said fluid being supplied via said fluid pressurization means; or (iv) detecting the presence of said fluid; in order to provide data to a recordal device, wherein such data will thereby give a well operator information as to the relative ease of penetration of fluid at each of the discrete intervals along the wellbore.

After such above information-gathering procedure, in a preferred embodiment of the above methods, high pressure fluid, namely at a pressure above formation dilation pressure, is then supplied to one of said first or second wellbores, at each of the discrete intervals from which the recorded values indicate it would be likely beneficial to oil recovery to provide formation dilation in such regions.

The manner of supplying the high pressure fluid, at pressures above formation dilation pressure, after completion of the information-gathering operation, preferably comprises supplying such fluid to one of said first or second wellbores in a series of successive pressure pulses, all at a second pressure above a formation dilation pressure at the discrete intervals previously determined in the information gathering step to require or be recommended to be subject to, formation dilation.

Clearly, the present invention further extends to using the above information-gathering procedure to determine, for each discrete interval a value indicative of an amount, or a rate of penetration, or whether there is penetration, of said fluid, and compiling a plurality of values and associated discrete locations along said wellbores; and (iv) using the discrete intervals determined in the preceding step which have associated values indicating the highest amount of, rate of, or simply penetration of, said fluid into said second wellbore, to determine those regions along and/or between said wellbores where formation dilation by injection of a fluid would be undesirable or not useful.

Another aspect of the present invention related to the above information-gathering method for determining regions of the formation most likely to benefit from subsequent stimulation relies on the fact that regions of the formation determined to have easy fluid penetration are likely to be regions in the formation containing significant amounts of water.

Accordingly, in another aspect the invention relates to a method of reducing, within a hydrocarbon-containing formation, the potential for ingress of water from said formation into a collection wellbore situated in said formation, comprising the steps of:

(i) placing within a first wellbore, at a plurality of discrete intervals along a length thereof, fluid pressurization means which allow for supply of a pressurized fluid to said formation at a region proximate each of said discrete intervals;

(ii) applying, via said fluid pressurization means, a fluid at each of said discrete intervals, at a first pressure below formation dilation pressure;

(iii) sensing, via sensing means within said collection wellbore situated parallel to said first wellbore, at corresponding discrete intervals along the length thereof, a value indicative of ease of penetration of said fluid within a region of said formation proximate said discrete intervals and thereby compiling a plurality of values at associated discrete locations along said wellbores; and (iv) using the discrete intervals determined in step (iii) above which have associated values indicating the highest ease of penetration of fluid into said formation to determine those discrete intervals along the wellbores where inserting a plugging means in said region of said wellbores would reduce the possibility of water entering said wellbores at said discrete intervals; and (v) inserting plugging means within at least one of said wellbores to seal said wellbore(s) at said discrete locations determined in step (iv) above.

The step, once the information-gathering procedure has been completed, of subsequently applying fluid to the discrete intervals determined to be in need, is preferably provided by way of high pressure pulses so such discrete intervals, in either the first or second wellbore. A novel tool determined to be suitable for applying, downhole, such pressure pulses when supplied with a pressurized fluid pumped downhole, is a tool which comprises:

a cylindrical elongate member, having an upstream end and a mutually-opposite downstream end;

a reservoir chamber, situated at said downstream end, said chamber bounded at an upstream end thereof by a slidable piston member;

tubular passageway means, extending substantially a length of said elongate member, in fluid communication with said reservoir chamber and providing fluid communication between a fluid inlet at said upstream end and said reservoir chamber;

a fluid exit passage;

a valve member contacted by said tubular passageway means, having an open position and a closed position, for allowing and preventing fluid flow from said inlet area to said fluid exit passage; and biasing means biasing said slidable piston member against fluid in said reservoir chamber and further biasing said tubular passageway means against said valve member so as to bias said valve member to said open position which allows fluid to exit said tool via said fluid exit passage.

In operation, upon fluid being supplied to said fluid inlet of such tool at said upstream end, and the valve member being in a closed position, fluid pressure in said reservoir chamber increases due to fluid supplied to said reservoir chamber from the fluid inlet via said tubular passageway means. The slidable piston member is caused to move upstream against said biasing means, and the biasing means then forces said tubular passageway means to move said valve member to the open position and allowing fluid from said inlet area to exit the tool via said exit passage. Fluid exiting the tool via the exit passage thereby causes an instantaneous drop in fluid pressure in both said tubular passageway means and the reservoir chamber, thereby causing said sliding piston to move downstream in said reservoir chamber and allowing said valve member to move to a closed position. The cycle then repeats for the tool, and is self-sustaining until fluid pressure supplied from surface is relaxed or halted.

BRIEF DESCRIPTION OF THE DRAWINGS

The accompanying drawings illustrate one or more exemplary embodiments of the present invention and are not to be construed as limiting the invention to these depicted embodiments. The drawings are not necessarily to scale, and are simply to illustrate the concepts incorporated in the present invention.

DETAILED DESCRIPTION OF PREFERRED EMBODIMENTS

Figure 1:
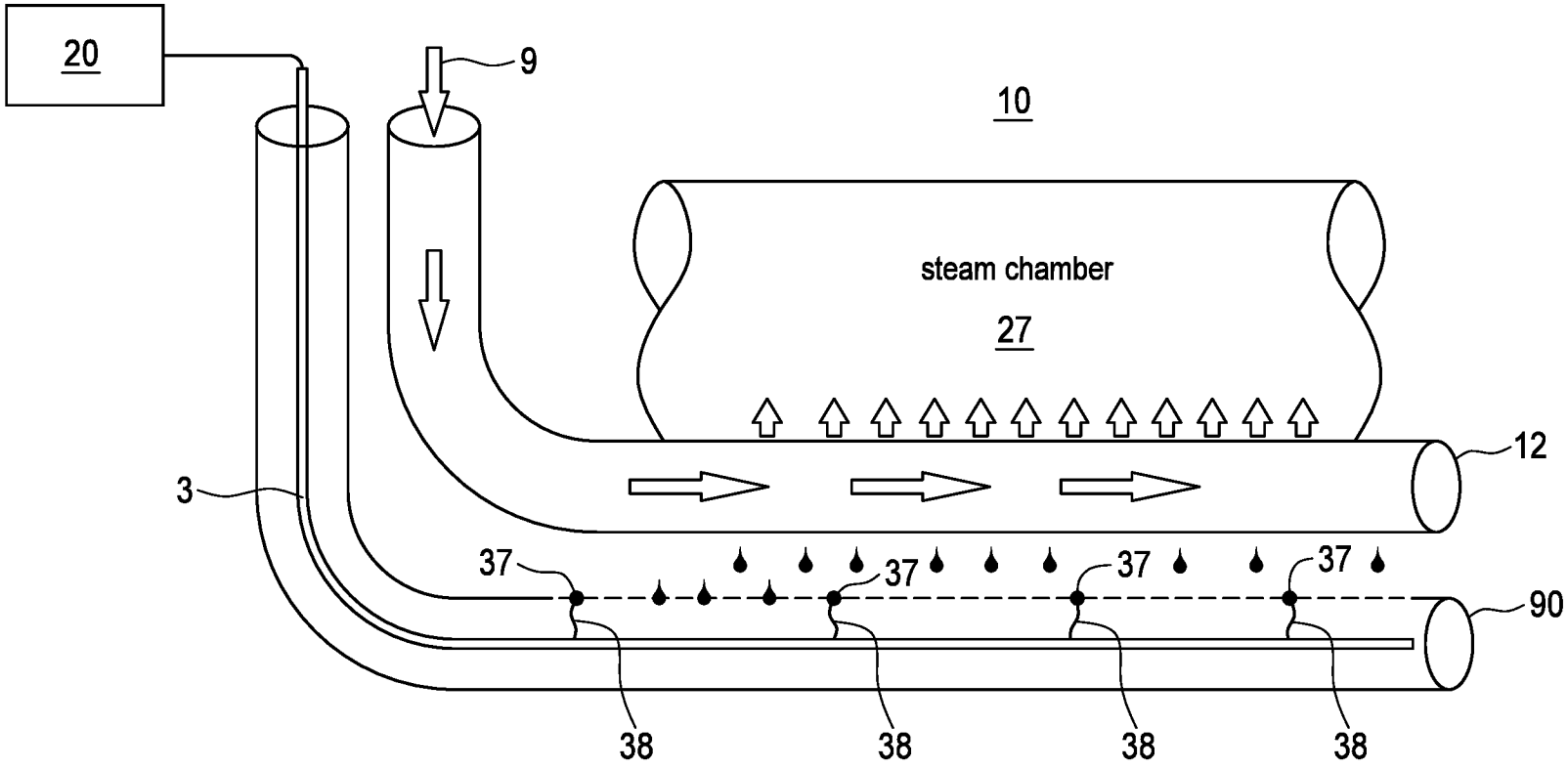
FIG. 1 (Prior Art)
FIG. 1 shows a cross-sectional schematic view of a SAGD well pair of the prior art, having an upper wellbore for injection of pressurized steam and a lower wellbore for collection of oil which drains downwardly therein, where temperature and pressure sensors have been installed in the lower collection well, such as by use of a fibre optic cable, to gather information in the collection wellbore as to the temperature and pressure of oil in such collection wellbore.

With reference to the drawings FIGS. 1-13, like or similar elements are designated by the same reference numeral through several views. However, such elements are not necessarily shown to scale in drawings FIGS. 1-13.

FIG. 1 shows a typical SAGD well pair, comprising a pair of mutually parallel horizontal wellbores 12 and 90, generally spaced, to the extent possible when drilling, a uniform distance apart.

In SAGD operations, steam 9 is injection into first (upper) wellbore 12, which steam generally passes upwardly and heated oil then drains downwardly, with steam flowing into regions above the first wellbore 12 vacated by the oil and thereby forming a steam chamber 27. Condensation of steam in the steam chamber 27 releases further heat into the formation 10 due to latent heat of condensation being released from the steam when it condenses forms a steam chamber, thereby further improving recovery.

Frequently, production engineers will introduce sensors 37 into collector well 90, linked to a common bus line 3 via tie lines 38, which bus line 3 passes to surface and to a display device 20, for displaying pressure and temperature at the various sensors 37.

Information provided by sensors 37 is useful to the well operator in allowing the operator to adjust the steam quality and temperature (ie the degree of superheating, in some cases) to achieve sufficient temperatures in the wellbore 90 to collect oil therein and continue flow therein, and sensing of pressure in collector wellbore 90 is useful to determine if there has been any breakthrough of pressurized steam into collection wellbore 90.

Disadvantageously, however, the such method as shown in FIG. 1 of displaying temperatures and pressures downhole in wellbore 90 during the SAGD recovery process does nothing to assist in determining where pre-SAGD stimulation operations would be most suitable to improve subsequent oil recovery during the SAGD process via the collector wellbore 90, nor for that matter determining where pre-SAGD stimulation operations would be of little benefit in view of differing geology and properties of the reservoir at different discrete intervals along the wellbores.

Figure 2:
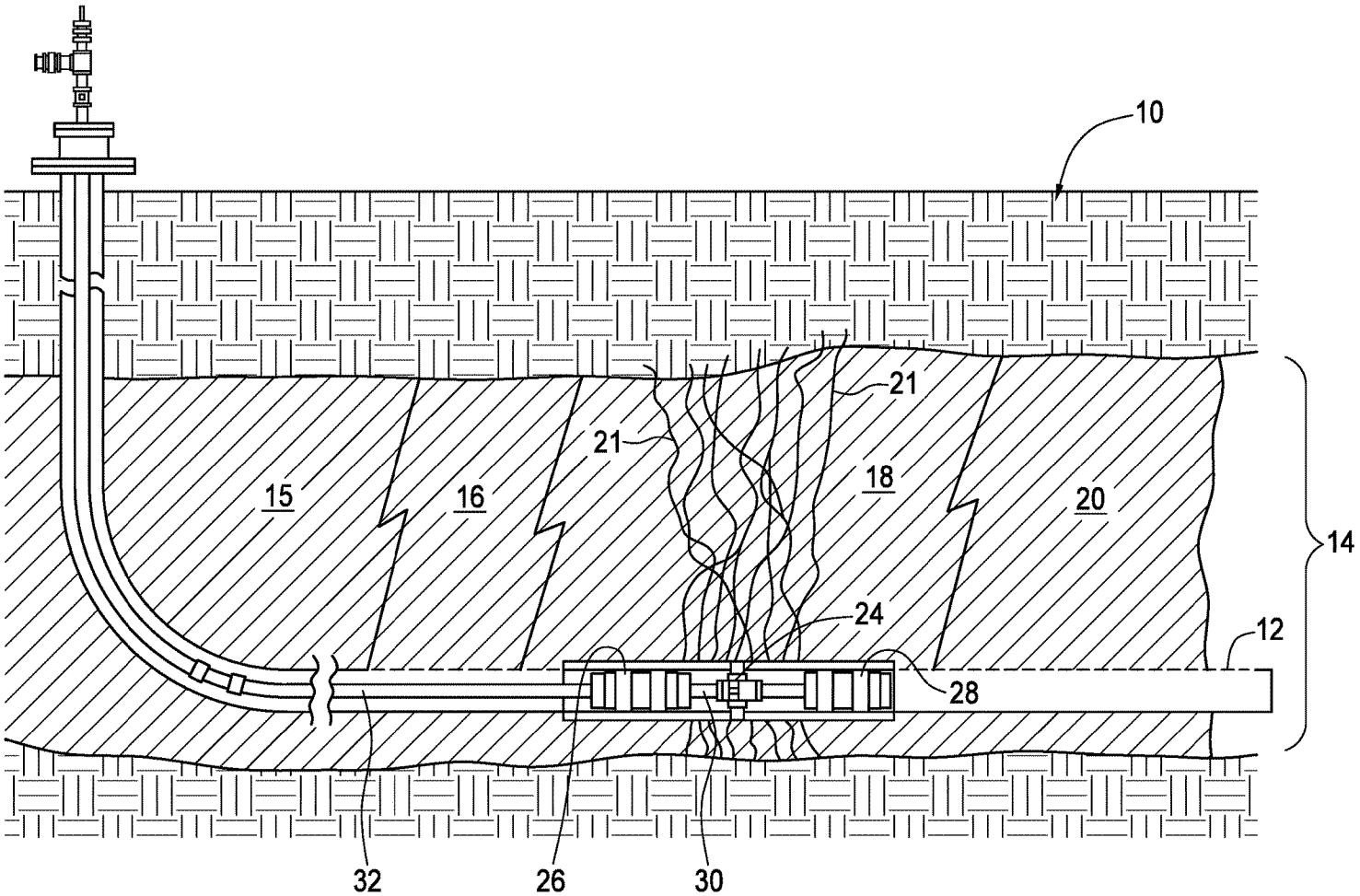
FIG. 2 (Prior Art)
FIG. 2 shows a cross-sectional view of a single wellbore using a method of the prior art for fracturing regions within a hydrocarbon-containing formation. A fluid supply tool is situated between two packer elements and located at the distal end of tubing inserted downhole in a wellbore, and is supplied with fluid under a pressure exceeding wellbore dilation pressure, which causes fracture of rock in the formation surrounding the wellbore.

FIG. 2 for its part shows a cross-sectional view of a hydrocarbon-containing formation 10 having a horizontal wellbore 12 drilled within a "pay" zone 14 thereof, which depicts a prior art method of stimulation regions 15, 16, 18, and 20 of hydrocarbon-containing formation 10, with region 18 shown being fractured by fluid pressurization via tool 24, thereby creating of fissures 21 within rock surrounding wellbore 12. In such prior art method, a fluid pressurization means, such as a downhole tool/valve 24, interposed between two double-packer elements 26, 28 and located at the distal end 30 of a tubing 32, which may be continuous coiled tubing, or discrete lengths of a piping string, is inserted downhole in wellbore 12 for providing cyclic pressure pulses, at a pressure above formation dilation pressures, at various discrete intervals along wellbore 12, to cause formation dilation and/or stimulation of rock in the formation 10. Specifically, in such prior art method depicted in FIG. 1, downhole tool/valve 24 is supplied with fluid under a pressure exceeding wellbore dilation pressure, which causes fracture of and fissures 21 in rock within formation 10, and in particular within region 18 surrounding the wellbore 12. Downhole tool/valve 24 is subsequently repositioned to other remaining discrete intervals along wellbore 12, so as to successively fracture regions 15, 16 and 20 along wellbore 12, so that the formation 10 is fractured along the entirety of the length of wellbore 12 and thus at each of regions 15, 16, 18, and 20 therealong.

Notably, hydrocarbon-containing formations 10 typically are non-homogenous, possessing distinct regions such as regions 16, 18, and 20 through which wellbore 12 passes and which thus border wellbore 12. Each of separate distinct regions such as regions 16, 18, and 20 which are shown for illustrative exemplary purposes, typically possess distinct and separate geological properties, such as of different densities and porosity, rock type (and whether such rock is of a consolidated or unconsolidated nature), and each of varying levels of oil and water saturation.

Thus disadvantageously, as explained in the "Background of the Invention" herein, where the characteristics of the formation 10, and in particular the geology, individual properties of, and number of, distinct regions with formation 10, and in particular in such regions as regions 16, 18, and 20 which border wellbore 12 may not be completely understood or known as to all properties, injection of pressurized fluids along an entire length of a wellbore 12 may inadvertently inject liquids into regions of formation 10 such as, for example, region 18 of the formation 10, where the porosity of the formation at such region 18 may already be such that stimulation is not needed. Thus indiscriminate stimulation in regions immediately surrounding wellbore 12, such as region 18 which may be sufficiently porous and/or or of a geology to not require dilatation, results in wastage of fluid and delay in completing stimulation along wellbore 12. Wasteful use of injected fluid is of particular concern in locations around the world where sources of surface water to be pumped downhole (water being typically a principal component of the injected fluid) is scarce and difficult to obtain.

Also disadvantageously, hydrocarbon reservoirs often possess regions of higher water content and higher water saturation. Stimulation along an entirety of the length of a wellbore 12 and thus in all regions 16, 18, and 20 of a formation 10 bounding a wellbore 12 will typically undesirably result in stimulation of rock in one or more higher water content regions. Such stimulation thereby allows water therein to more easily flow out of such regions such as region 18 and into the wellbore 12, and preferentially allows water to flow from these regions 18, thereby detrimentally affecting recovery of hydrocarbons through the wellbore 12.

Accordingly, for the above reasons, indiscriminate stimulation methods of the prior art which stimulates formation 10 along an entire length of a wellbore 12, or even in selected lengths without having intimate knowledge of the in-situ geology and in particular the permeability and fluid saturations of the formation 10 in each of regions along and proximate wellbore 12 often leads to reduced recovery from the formation 10 than would otherwise be the case if the permeability and fluid saturations and "tightness" of the oil at each and all of the discrete intervals along the wellbore 12 was otherwise known, or known with greater precision.

Figure 8:
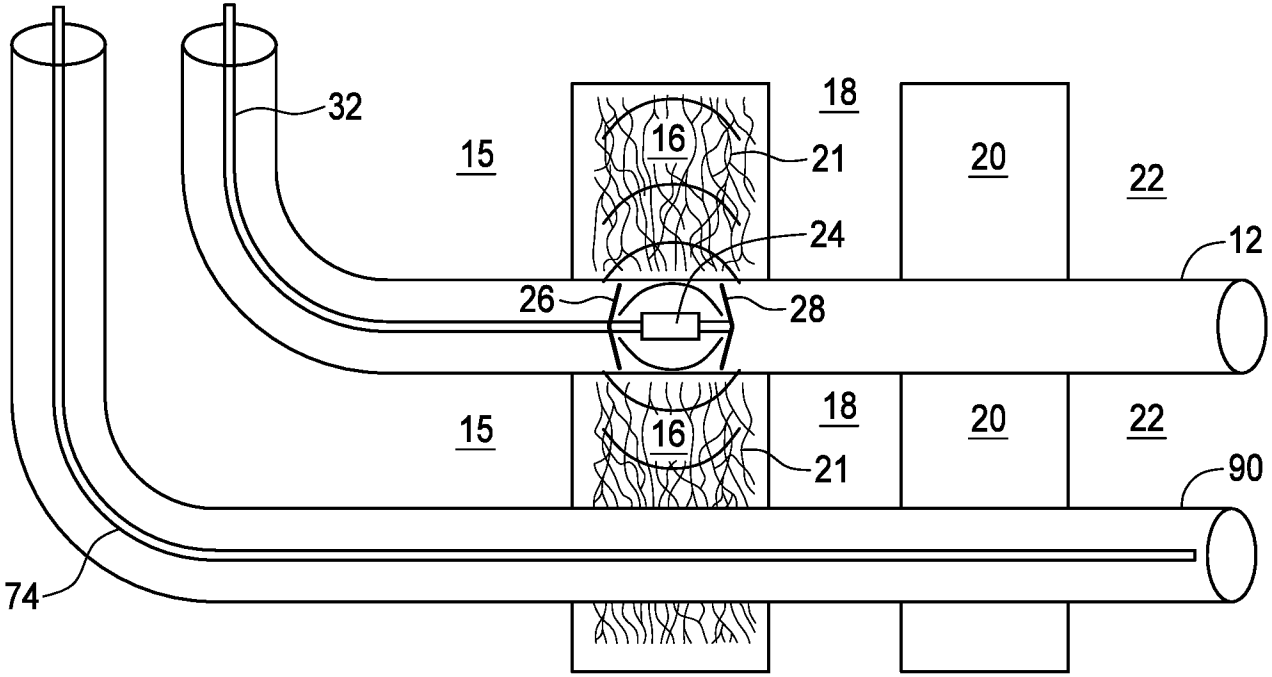
FIG. 8 is a similar cross-sectional view of the wellbore, after completion of the above "information gathering" steps, wherein the fluid pressurization tool is positioned at a first location in the wellbore where is was determined by the foregoing "information gathering" steps that stimulation would be beneficial, wherein such pressurization tool is provided with fluid under pressure at the pre-determined desired interval, and stimulation of the surrounding rock is being carried out.
Figure 9:
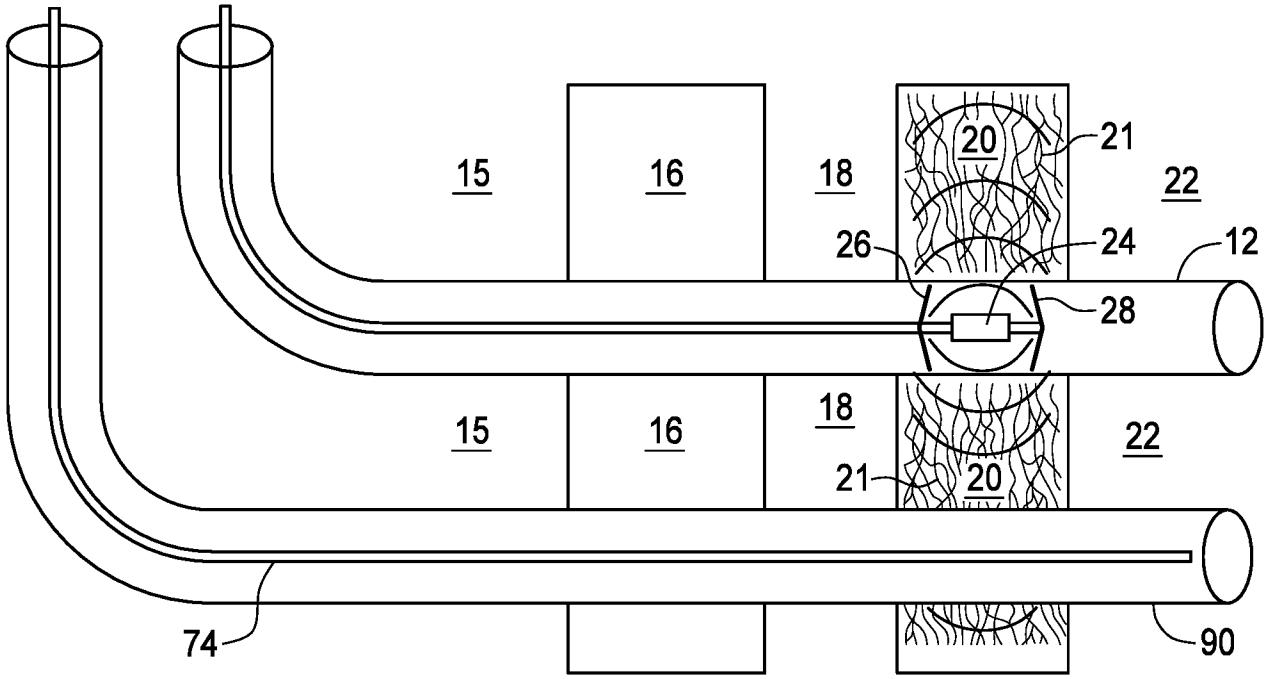
FIG. 9 is a similar cross-sectional view of the wellbore, after completion of the above "information gathering" steps, wherein the fluid pressurization tool is positioned at a second location in the wellbore where is was determined by the foregoing "information gathering" steps that stimulation would be beneficial, wherein such pressurization tool is provided with fluid under pressure at one of the pre-determined interval, and stimulation of the surrounding rock is being carried out at such interval.
Figure 12:
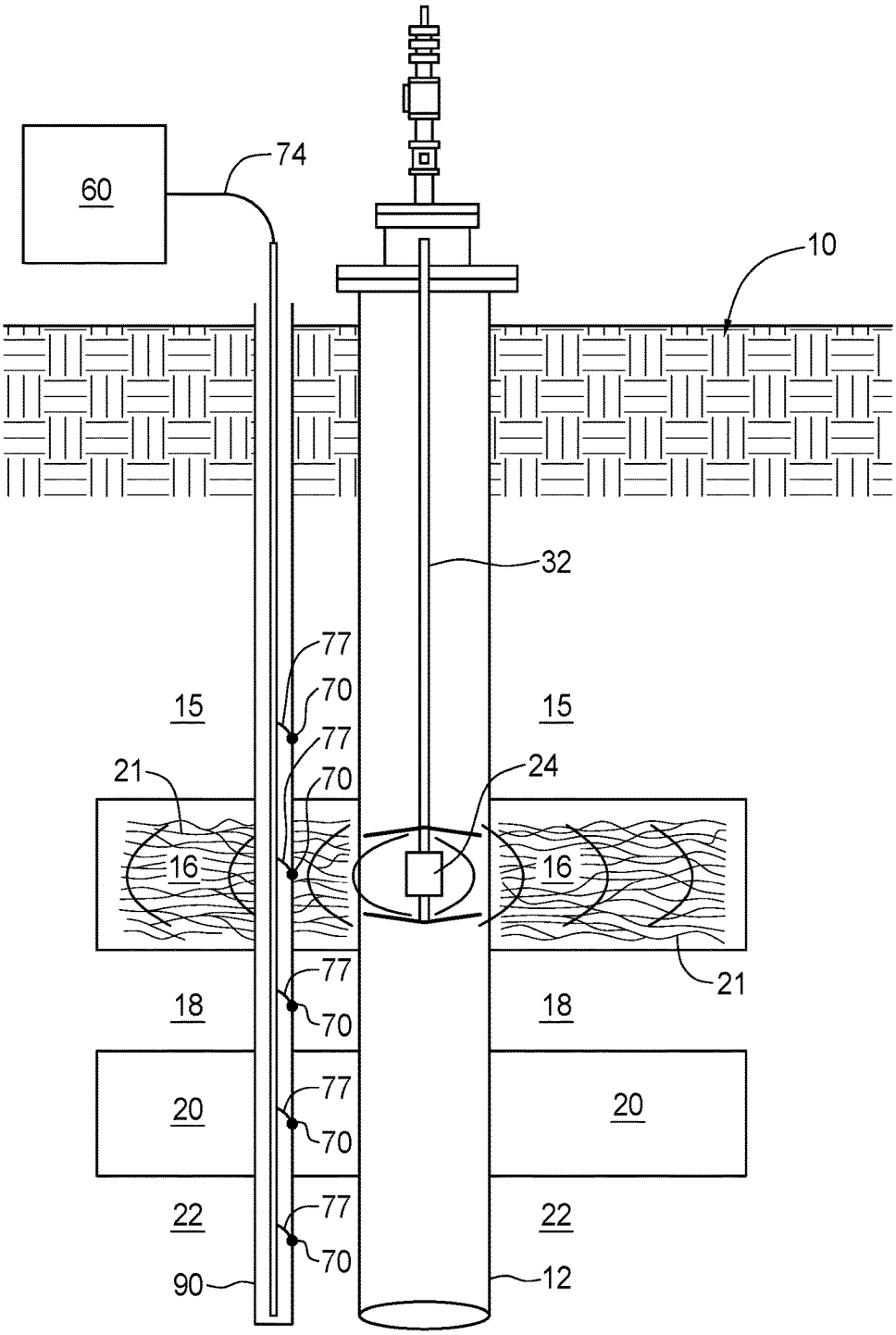
FIG. 12 is a cross-sectional view of another embodiment of the method of the present invention, wherein a pair of vertical wells are employed, and the "information-gathering" step has been carried out along discrete intervals along one of such vertical wells and a particular distinct interval therealong has been identified as having characteristics for which stimulation may be beneficial, and a downhole tool is being used to provide stimulation of surrounding rock at such identified interval.

The method of the present invention, as shown schematically in FIGS. 3-9, 12 and FIG. 13, provides an initial information-gathering step to be carried to determine geology and in particular permeability and fluid saturations of the formation in regions along and between the two wellbores 12, 90 at pressures below formation dilation pressures, prior to conducting actual fracturing or formation dilation at pressures above formation dilation pressures, as shown in FIGS. 8, 9, and 12. Such information-gathering method allows initial acquisition of information as to reservoir/formation characteristics, in particular information as to ease of fluid penetration at discrete intervals along the entirety of the length of wellbore 12 (ie information with regard to the formation in regions directly bordering the wellbore 12, and between wellbore 12 and wellbore 90), namely those regions such as for example regions 15, 16, 18, 20, and 22 bordering wellbore 12 and extending outwardly therefrom, to allow identification of optimum locations for a subsequent stimulation operation.

Figure 3:
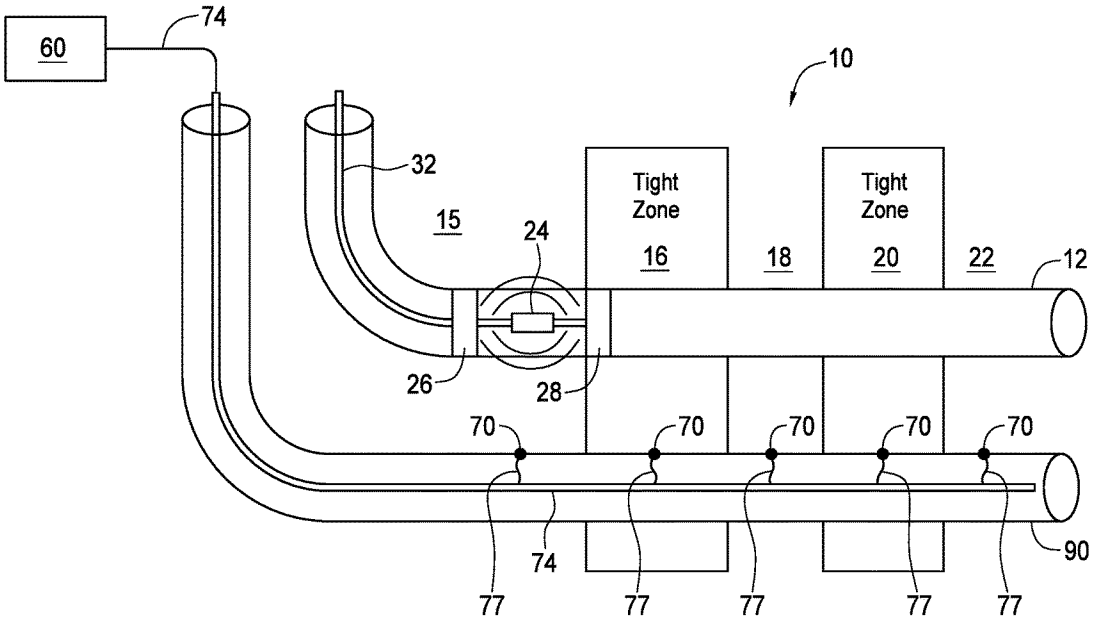
FIG. 3 is a cross-sectional view of the "information-gathering" method of the present invention, employing a first and second wellbore for obtaining reservoir characteristics of the formation at discrete locations along the wellbores, showing a pressurized fluid supply tool interposed between two packer elements and located at the distal end of tubing within the first (upper) wellbore, wherein sensor means are located at discrete intervals along the second (lower) wellbore parallel to the first wellbore, and the pressurized fluid supply tool is located at a first of said discrete intervals along the first wellbore.
Figure 4:
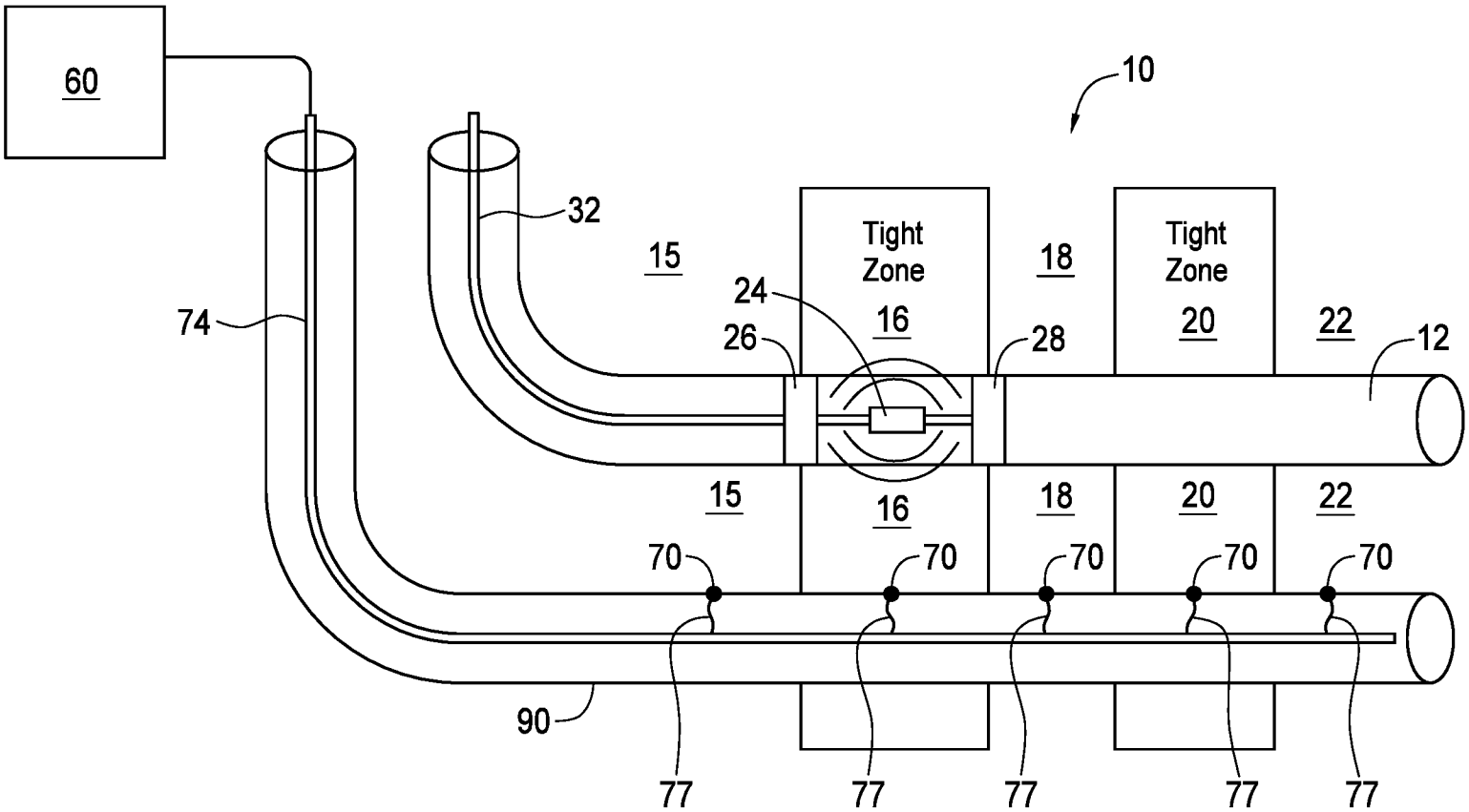
FIG. 4 is a similar cross-sectional view of the "information-gathering" method of the present invention, at a further successive step in the method, where the fluid pressurization means has been subsequently re-positioned to a second of such discrete intervals along the wellbore and fluid (at a pressure less than formation dilation pressure) is supplied.
Figure 5:
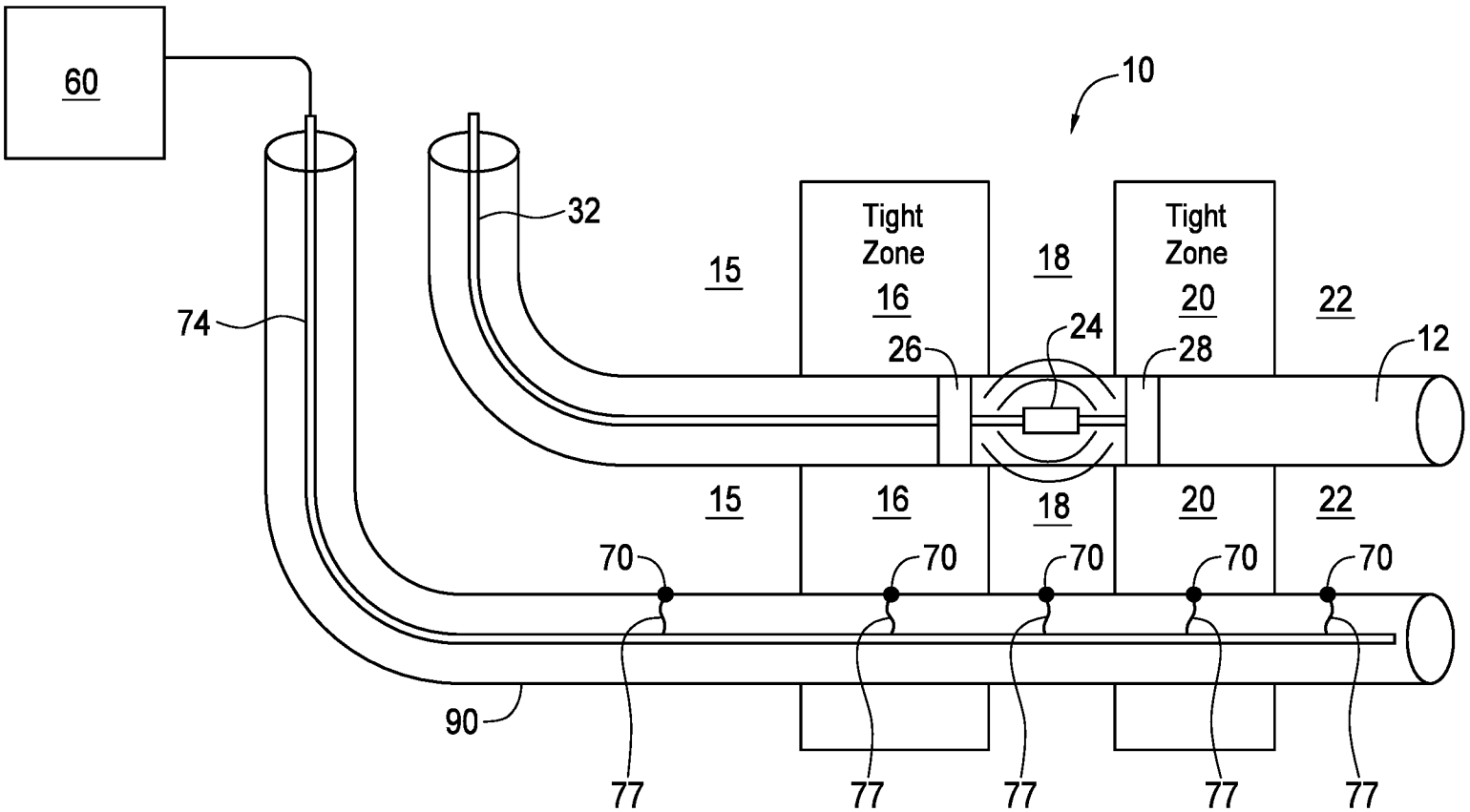
FIG. 5 is a similar cross-sectional view of a wellbore using the "information-gathering" method of the present invention, at a further successive step in the method, where the fluid pressurization means has been subsequently re-positioned to a third of such discrete intervals along the wellbore, and fluid pressure (less than formation dilation pressure) being supplied.
Figure 6:
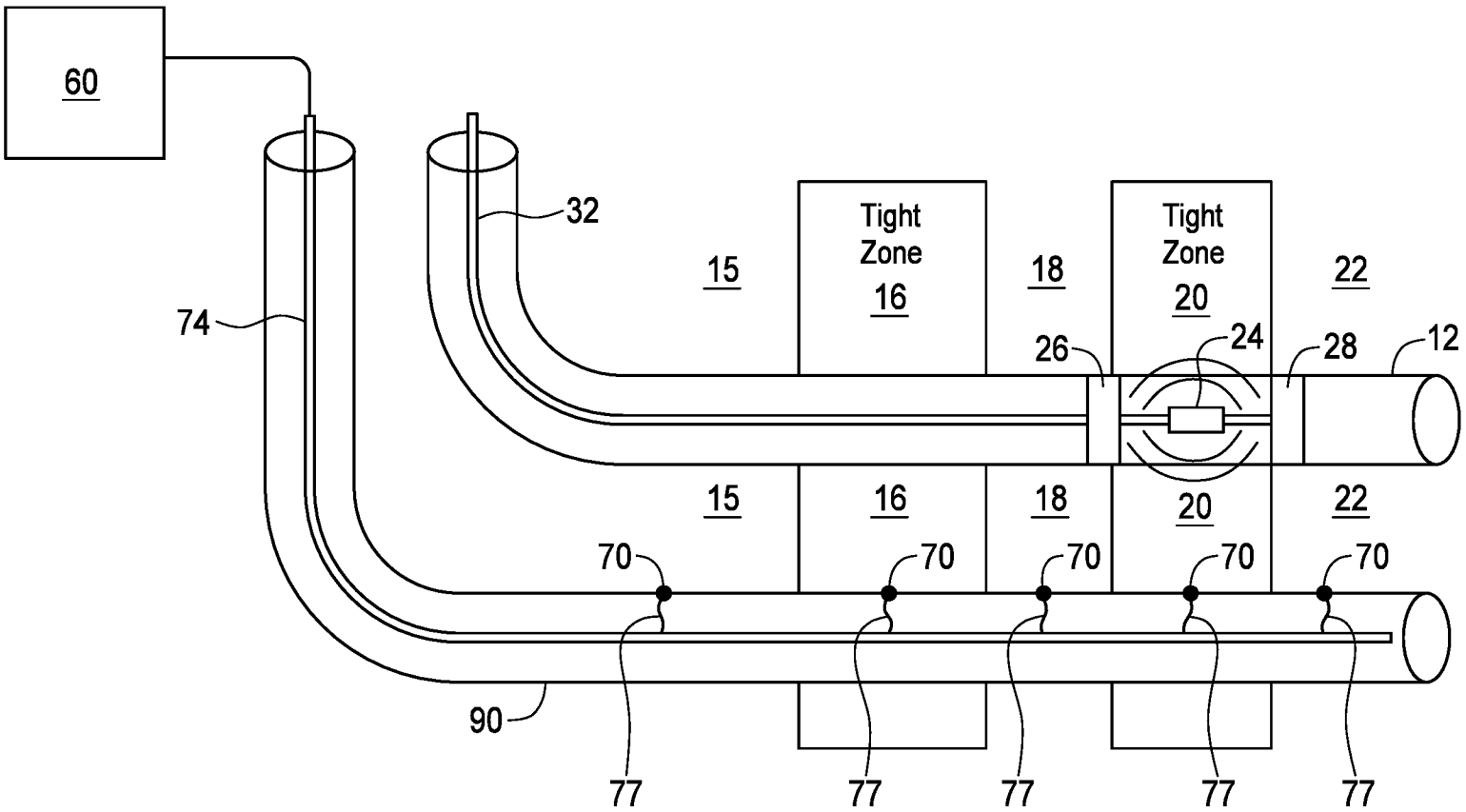
FIG. 6 is a similar cross-sectional view of a wellbore using the "information-gathering" method of the present invention, at a further successive step in the method where the fluid pressurization means has been subsequently re-positioned to a fourth of such discrete intervals along the wellbore, and fluid at a pressure less than formation dilation pressure is supplied.
Figure 7:
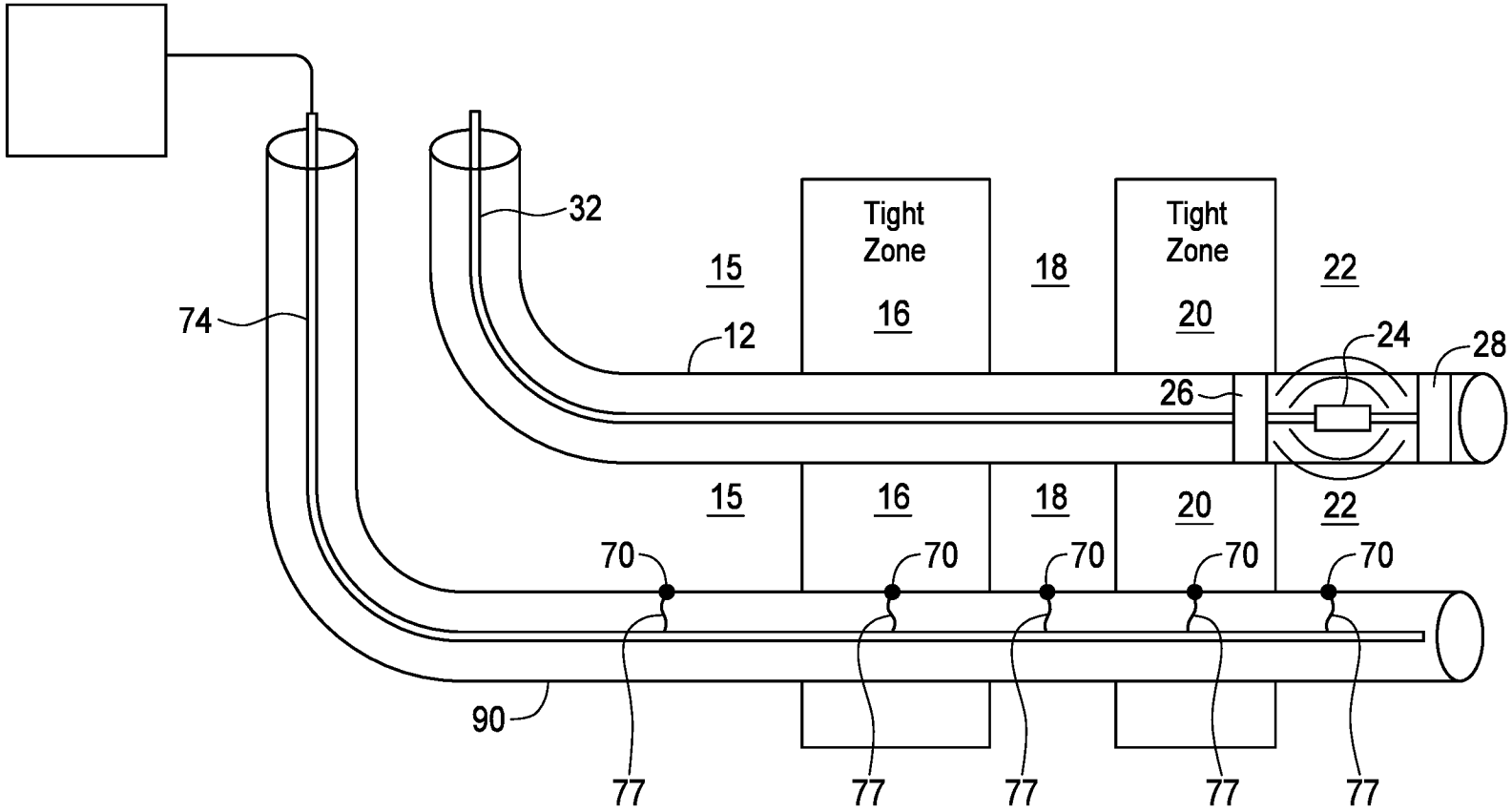
FIG. 7 is a similar cross-sectional view of a wellbore using the "information-gathering" method of the present invention, at a further successive step in the method, where the fluid pressurization means has been subsequently re-positioned to a fifth of such discrete intervals along the wellbore, and fluid at a pressure less than formation dilation pressure is supplied.

In this regard, FIG. 3 depicts an initial step in such method. Fluid pressurization means in the form of a downhole tool/valve 24 is first interposed between two packer elements 26, 28 and located at the distal end 30 of a tubing 32 within upper wellbore 12 (Alternatively tool/valve 24 and associated packers and tubing 32 could be inserted in lower wellbore 90, and sensor means 70 (discussed below) alternatively located in upper wellbore 12].

Downhole tool/valve 24 and associated packers 26, 28 are inserted via tubing 32 downhole in wellbore 12, at an initial discrete interval along wellbore 12, as shown in FIG. 3. When the downhole tool/valve 24 is positioned at such initial discrete interval, a fluid such as water is supplied to such valve 24, at a pressure less than formation dilation pressure. A plurality of sensors 70 are provided at spaced discrete intervals along wellbore 90. Sensors 70 are in communication, preferably via communication line(s) 74 with surface. In one embodiment communication line 74 comprises a plurality of electrical lines, with each individual sensor 70 in electrical communication therewith via corresponding electrical feeder lines 77, all in electrical communication with communication line 74 and thus with surface. Other means and manners of sensors 70 being in communication with surface will now be apparent to persons of skill in the art, such as by fibre optic cable or such other means, such as single bus line 74 with separate channels for each sensor 70.

Communication line(s) 74 is/are in communication with recordal means 60 at surface. Recordal means 60 is provided for electronically receiving and storing information, as more fully explained below, which is supplied by sensors 70, and may comprise a personal computer having a hard drive or flash memory (not shown), and may further comprise multiplexing means (not shown) if only one communication line 74 is used, in order to be able to receive and record data simultaneously from sensors 70, which may be numerous depending on the spacing of the discrete intervals and the length of wellbore 12.

Only one sensor 70 need be used with the method shown in FIG. 3-7, which sensor 70 progressively moves in conjunction with downhole tool 24 from discrete interval to subsequent discrete interval. Alternatively a plurality of sensors 70 may be employed as shown in FIGS. 3-7, with a respective sensor 70 providing information/data for each particular discrete interval.

Sensor(s) 70 are adapted to provide very localized data/information as to the ease of penetration of fluid through a particular region of the formation 10 proximate a given discrete interval along wellbore 12, 90. Sensors 70, alone or in combination with recordal means 60 [recordal means 60 may not only provide a data recordal function, but may further provide subsequent data manipulation, such as to convert raw flow rates of fluid into flow rates per a given measured time interval for each of the respective discrete locations], are each adapted to sense one or more of the following parameters:

(i) magnitude of a pressure wave received at wellbore 90, upon provision of a pressure pulse in wellbore 12, the latter having apertures therein to allow egress of fluid under pressure into regions 15, 16, 18 & 20 of the formation 10). For such purposes numerous existing pressure sensing devices 70 may be suited, provided each adapted to withstand temperatures and pressures to which the devices may be subject downhole;

(ii) the extent of penetration of fluid, if any, at and in the region above the location of a respective sensor situated in wellbore 90. In such case, such sensors 70 may, in one embodiment, comprise a pair of electronic probes which sense variations in electrical resistivity or conductivity of the formation 10 in the regions such as region 15 which is the particular region 15 being subjected to fluid penetration from tool/valve 24 in FIG. 3, both before and after being subject to such fluid pressure via tool/valve 24, relying on the principal that the electrical resistivity/conductivity of formation 10 is dependent on the extent of water saturation, particular where the saturating water contains electrically conductive brine as is frequently and often the case in underground formations and/or when the injected fluid being injected via tubing 32 is an ionic and thus electrically conductive fluid such as brine. Sensors 70 in such embodiment comprise one half member of a pair of electrical probe members, with the other corresponding probe members being located along similar spaced discrete distances on top of, or within each region 15, 16, 18, & 22, to thereby measure the electrical resistivity of a region before, and after, being subjected to fluid pressure, to thereby obtain relative comparable value as between the regions 15, 16, 18, 20 and 22 as to the extent of fluid penetration within a particular region relative to other regions.

FIGS. 4, 5, 6 & 7 further depict successive stages of the information gathering method of the present invention, showing successive movement of the downhole tool 24 and associated packer elements 26, 28 along wellbore 12 toward and up to the toe of wellbore 12, with successive application of fluid pressure via tool 24 at each of respective successive discrete intervals along wellbore 12 for supply of pressurized fluid to successive regions 16, 18, 20, and 22 of formation 10, with the gathering by sensor (s) 70 of the above information/data at each of the respective discrete intervals shown in FIGS. 4-7.

Figure 13:
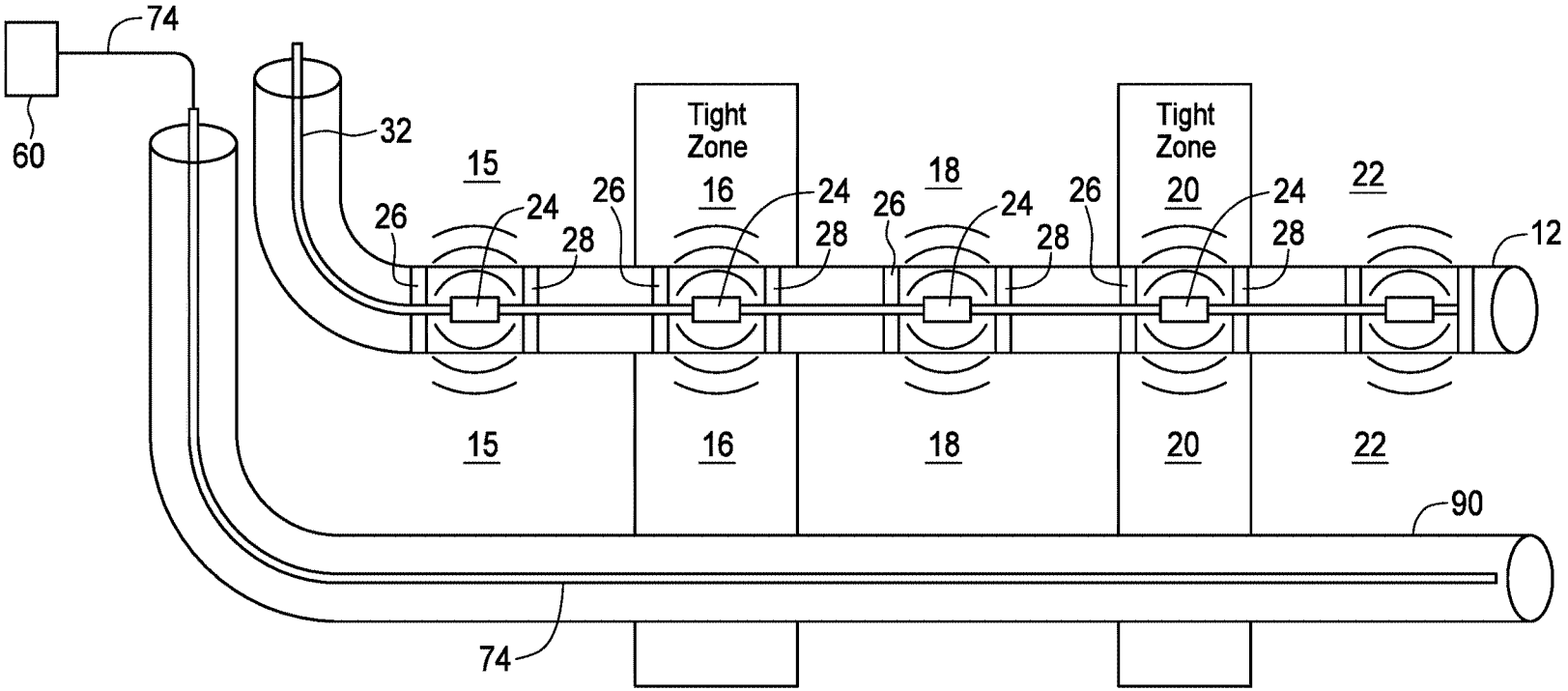
FIG. 13 depicts a cross-sectional view of a pair of wellbores, using a modified form of the "information-gathering" method of the present invention, which advantageously is able to gather information simultaneously along the entirety of the wellbore.

FIG. 13 shows an alternative embodiment of the method of the present invention.

In such method shown in FIG. 13, a plurality of downhole tools 24 are provided along wellbore 12, each interposed between respective packers 26, 28 which together provide a respective pressure seal within wellbore 12 so as to prevent fluid from downhole tool 24 from passing upwell or downwell and thereby ensure that the fluid is directed through porous wellbore 12 and into formation regions 15, 16, 18, 20, and 22. Wellbore 12 may be comprised of well casing having screens or apertures (not shown) therein to allow fluid communication with regions 15, 16, 18, 20, and 22 which allow, to a measured extent, fluid penetration into respective regions 15, 16, 18, 20, and 22 of formation 10. In this method all of downhole tools/valves 24 and associated packer elements 26, 28 are positioned at the end of tubing 32 and inserted downhole within the length of a wellbore 12.

In this method, pressurized fluid is applied simultaneously to each of the five (5) discrete intervals along wellbore 12, and sensors 70 provide data relative to the ease of penetration of the fluid within each of the respective regions 15, 16, 18, 20 and 22 along wellbore 12. Thereafter, upon analysis of the data obtained from sensors 70 via communication line 74 indicating relative ease of penetration of fluids within various regions of formation 10 as recorded by recordal means 60, those regions having poor ease of penetration (such as for example, the "tight" regions 18 and 20) can be individually and successively selected for subsequent supply of a pressurized fluid at pressures above formation dilation pressures, so as to cause fracturing and fissures 21 in the rock surrounding wellbore 12, as shown in successive FIGS. 8 & 9.

FIG. 12 is an example where the method of the present invention may be adapted for use in a pair of vertical wellbores 12 and 90, instead of the horizontal wellbores 12, 90 depicted in FIGS. 3-9. The method and apparatus used in FIG. 12 are identical to the method and apparatus disclosed in FIGS. 3-9.

FIGS. 8 & 9 respectively show application of fluid pressure, at a pressures above formation dilation pressure, to respectively regions 18 and 20, determined by the information-gathering portion of the method of the present invention, to be regions of poor fluid penetration and to be regions which would likely benefit from subjection to fluid under a pressure in excess of formation dilation pressure.

Figure 10A:
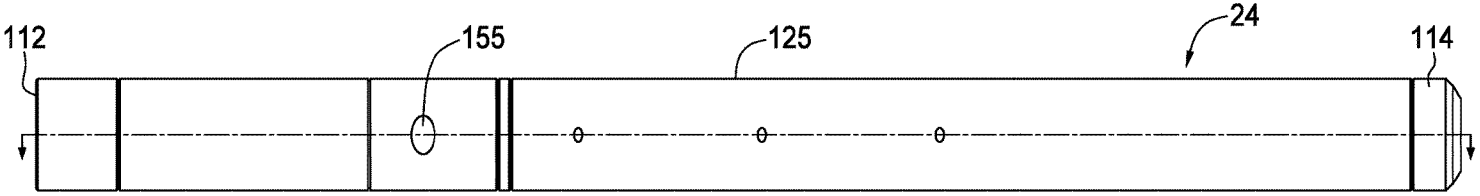
FIG. 10A is a plan view of a downhole tool/valve of the present invention for applying cyclic fluid pressure pulses, adapted to be mounted at a distal end of tubing which supplies such downhole tool/valve with pressurized fluid.
Figure 10B:
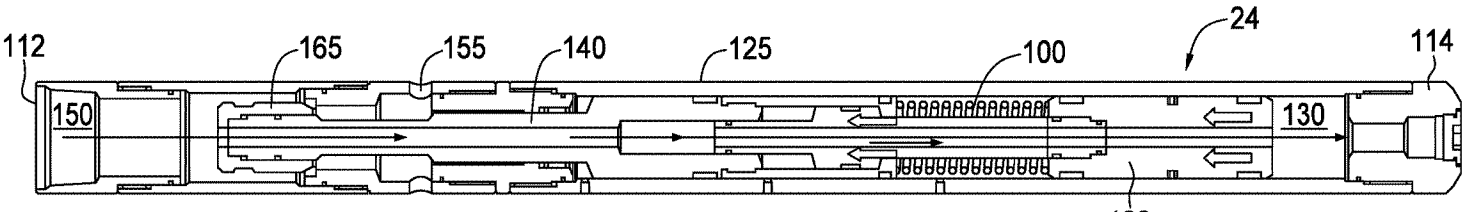
FIG. 10B is a cross-sectional view of the tool shown in FIG. 10A, taken along the longitudinal axis thereof, when the tool/valve is in the "closed" position.
Figure 10C:
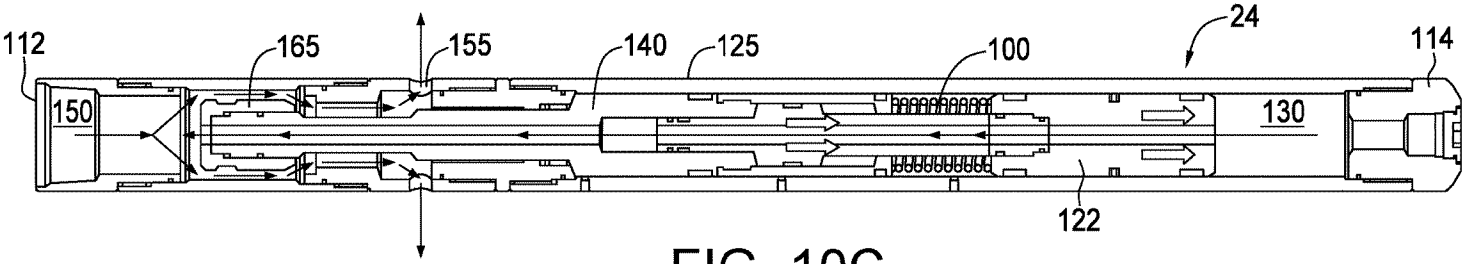
FIG. 10C is a cross-sectional view of the tool shown in FIG. 10A, taken along the longitudinal axis thereof, when the tool/valve is in the "open" position for supplying pressurized fluid to a discrete location along a wellbore.
Figure 11A:
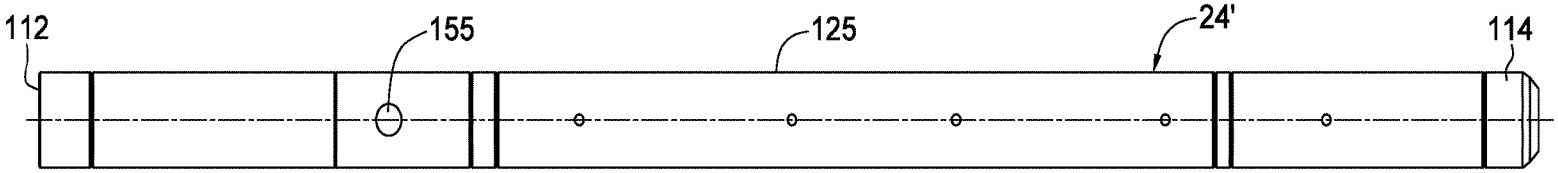
FIG. 11A is a plan view of another version of the downhole tool/valve of the present invention, similar to that shown in FIG. 10A.
Figure 11B:
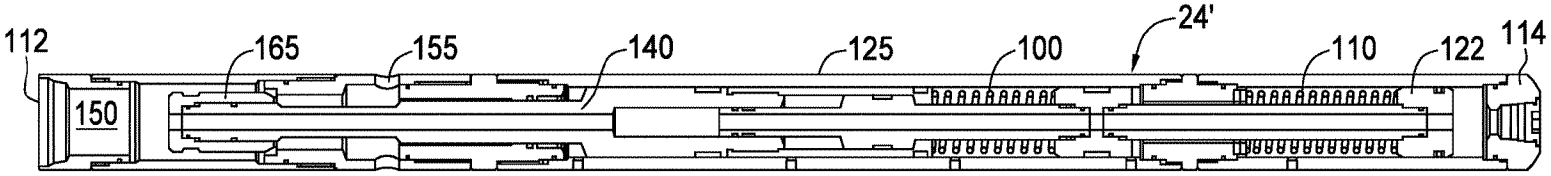
FIG. 11B is a cross-sectional view of the tool shown in FIG. 11A, taken along the longitudinal axis thereof, when the tool/valve is in the "closed" position.
Figure 11C:
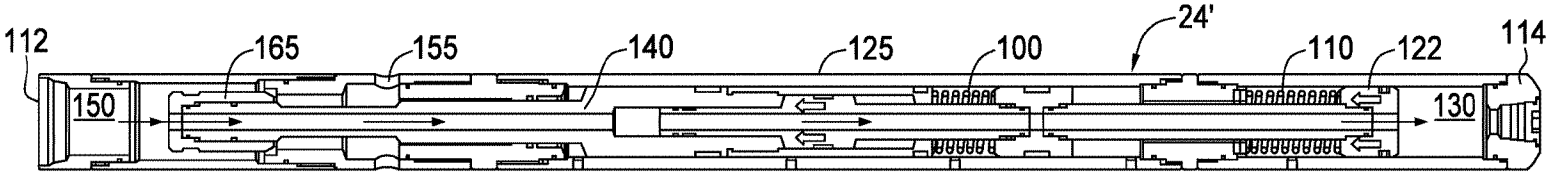
FIG. 11C is a cross-sectional view of the tool shown in FIG. 11A, taken along the longitudinal axis thereof, when the tool/valve is still in the "closed" position with the metering valve remaining seated, but with pressurized fluid being supplied to the tool/valve.
Figure 11D:
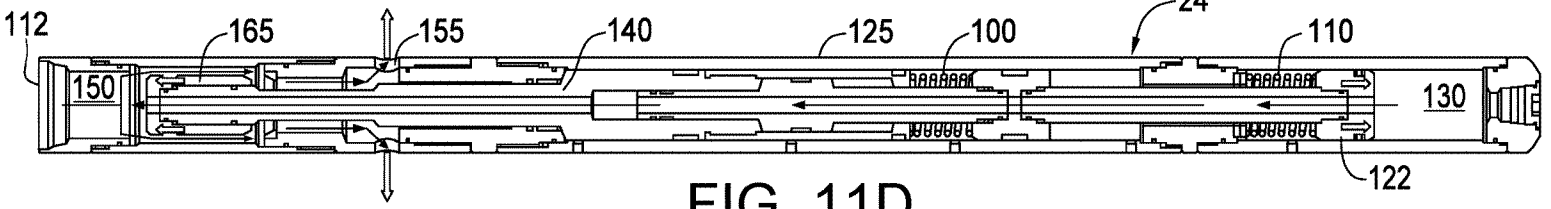
FIG. 11D is a cross-sectional view of the tool shown in FIG. 11A, taken along the longitudinal axis thereof, when the tool/valve is in the "open" position for supplying pressurized fluid to a discrete location along a wellbore.

FIG. 10A to FIG. 10C show a novel downhole tool/valve 24, useful for applying cyclic fluid pressure pulses, at either the initial information-gathering stage of the present invention, and/or the formation dilation stage of the present invention, possessing a single biasing member in the form of a spring 100.

With respect to the downhole tool/valve 24 shown in FIGS. 10A-10C, FIG. 10A is a exterior plan view thereof, comprising a cylindrical elongate member 125, having an uphole end 112 located on the left hand side of FIG. 10A, and a downhole end 114 thereof located at a mutually opposite end on the right hand side of FIG. 10A.

Each of FIG. 10B and FIG. 10C are cross-sectional views through the tool of FIG. 10A, with the tools/valve 24 shown in the "closed" position in FIG. 10B, and in the "open" position in FIG. 10C.

A reservoir chamber 130 is provided, situated at the downhole end 114, and bounded by a plug member 117 at the downhole end 114, and by a slidable piston 122. A tubular passageway 140 extends substantially a length of said elongate member 125, and is in fluid communication with reservoir chamber 130 and provides fluid communication between a fluid inlet 150 at said uphole end 112 and reservoir chamber 130.

A fluid exit passage 155 is provided in elongate member 125, which allows for controlled egress of fluid from tool/valve 24, wherein fluid flow through exit passage 155 is controlled by valve member 165. Valve member 165 is contacted by tubular passageway 140, and has an open position (FIG. 10C) and a closed position (FIG. 10B), for allowing and preventing fluid flow respectively from said fluid inlet 150 to said fluid exit passage 155.

Biasing means, in the form of helical spring member 100, is provided, and functions to bias slidable piston 122 against fluid in reservoir chamber 130 and further biases tubular passageway 140 against said valve member 165 so as to bias said valve member 165 to said open position which allows fluid to exit said tool 24 via said fluid exit passage 155.

In operation, upon fluid being supplied to fluid inlet 150 at said uphole end 112 of cylindrical member 125 and valve member 165 being in a closed position, fluid pressure in reservoir chamber 130 increases due to fluid supplied to said reservoir chamber 130 from the fluid inlet 150 via said tubular passageway 140, as shown in FIG. 10B.

Thereafter, slidable piston 122 is caused to move uphole against said spring 100, until such point as spring 100 is provided with sufficient compressive force to then suddenly force tubular passageway 140 to move valve member 165 to said open position as shown in FIG. 10C, and thereby allow fluid from said fluid inlet 150 to exit the tool 24 via said exit passage 155. Egress of fluid via passage 155 thereby causes a drop in fluid pressure in both said tubular passageway 140 and reservoir chamber 130, thereby causing said sliding piston 122 to move downhole into reservoir chamber 130, thereby reducing the force exerted by spring 100 and thus allowing valve member 165 to move back to a closed position as shown in FIG. 10B.

FIG. 11A to FIG. 11D show another novel alternative configuration for a downhole tool/valve 24', likewise useful for applying cyclic fluid pressure pulses at either the initial information-gathering stage of the present invention and/or the formation-dilation stage of the present invention.

The novel tool/valve 24' of FIGS. 11A-11D, in comparison to the tool/valve 24 shown in FIGS. 10A-10C, possesses an additional biasing member 110—all remaining components of tool/valve 24', and the manner of operation of valve/tool 24' and its components being substantially the same as the manner of operation and components described above in regard to the tool/valve 24 shown in FIGS. 10A-10C.

The reason for the desirability of adding a second spring 110 is that the tools/valves 24, 24' are basically a vibrational reciprocating devices, having an applied forcing function (the pressure of the fluid applied). Frequently a production engineer will wish to provide cyclic pulses at no greater than a given frequency, as pressure pulses compressed to too short a time interval (ie at too high a frequency) will negate the benefits of providing spaced-apart pressure pulses, and possibly vibrate regions of the formation to such an extent that unconsolidated rock within formation 10 is caused to fall undesirably closer together, much like shaking contents of containers which causes contents therein to settle and occupy a lesser total volume, thus undesirably filing created channels and fissures 21 in the formation 10.

Notably, the cyclic frequency by which the tool/valve 24, 24' operates (where no vibrational control is imparted at surface to the fluid supplied) is determined by such variables as the actual pressure of the fluid supplied to the valve 24 or 24' at inlet 150, the viscosity of the fluid and thus the consequent metering (damping) of fluid flow achieved in tubular passageway 140, the stiffness and length of the springs 100 and 110, and the mass of tubular passageway 140 and sliding piston 122, as well as the damping resulting from slidable frictional movement of such components within cylindrical member 125. Some of these variables the well production engineer may have little control over, and may wish to adjust the pressure pulse frequency by adjusting the parameters of the tool 24' directly over which he/she may have control.

Accordingly, by adding one additional spring 110 to the tool 24 of FIGS. 10A-10C, thereby effectively increasing the total length (and compression of) the springs 100, 110, where the added spring 110 may further be of a greater or lesser stiffness and/or a greater or lesser length than, first spring 100 of tool 24, additional ranges of adjustment of the vibrational system can be achieved for the tool 24' to thereby permit an optimal cyclic pressure pulse to be provided by tool 24' to the formation 10. In particular such modified design 24' allows the provision of pressure pulse frequency of an acceptable high pressure, but at a frequency lower than would otherwise be achievable for a tool having only a single spring 100.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method of determining, along a length of two parallel mutually adjacent wellbores situated in an underground hydrocarbon-containing formation, discrete regions in said formation along and intermediate said two wellbores where injection of a fluid into the formation may be necessary as compared to other regions along said two wellbores and intermediate said two wellbores for stimulating production of oil, comprising the steps of:

(i) placing within a first of said two parallel wellbores, at a plurality of discrete intervals along a length thereof, a fluid pressurization means for supply of a pressurized fluid at each of said discrete intervals along said first wellbore;

(ii) applying, via said fluid pressurization means, said fluid in a pressure pulse at a first pressure below formation dilation pressure, wherein a maximum pressure pulse is below a fracture pressure for said formation, at said plurality of discrete intervals along said first wellbore; and (iii) sensing, via sensing means situated in a second wellbore of said two parallel wellbores, at a plurality of discrete intervals situated along a length of said second wellbore corresponding to said plurality of discrete intervals along said first wellbore, a value or values indicative of ease of penetration of said fluid or magnitude of the pressure pulse of said fluid from said first wellbore to said second wellbore resulting from said application of said fluid at said plurality of discrete intervals along said first wellbore, and compiling said values;

(iv) using the values compiled in step (iii) to determine regions along and/or between said wellbores indicative of having difficulty of penetration of said fluid or the pressure pulse of said fluid, said regions having difficulty of penetration of said fluid or the pressure pulse of said fluid indicated by having values lower than the values associated with other regions along and/or between said wellbores, to thereby determine those regions along the wellbores where formation dilation, fracturing, stimulation, or injection of a fluid would be desirable;

wherein said step of applying pressure pulses comprises use of the fluid pressurization means wherein said fluid pressurization means comprises:

a cylindrical elongate member, having an upstream end and a mutually-opposite downstream end;

a reservoir chamber, situated at said downstream end, said chamber bounded at an upstream end thereof by a slidable piston member;

a tubular passageway means, extending along at least a portion of a length of said elongate member, in fluid communication with said reservoir chamber and providing fluid communication between a fluid inlet at said upstream end and said reservoir chamber;

a fluid exit passage;

a valve member contacted by said tubular passageway means, having an open position and a closed position, for allowing and preventing fluid flow from said fluid inlet to said fluid exit passage; and a biasing means biasing said slidable piston member against fluid in said reservoir chamber and further biasing said tubular passageway means against said valve member so as to bias said valve member to said open position which allows fluid to exit said tool via said fluid exit passage;

wherein upon fluid being supplied to said fluid inlet at said upstream end and said valve member being in the closed position, fluid pressure in said reservoir chamber increases due to fluid supplied to said reservoir chamber from the fluid inlet via said tubular passageway means, and said slidable piston member is caused to move upstream against said biasing means and said biasing means then forces said tubular passageway means to move said valve member to said open position and allow fluid from said fluid inlet to exit the tool via said fluid exit passage, thereby causing a drop in fluid pressure in both said tubular passageway means and said reservoir chamber, thereby causing said sliding piston to move downstream in said reservoir chamber and allowing said valve member to move to the closed position.

2. A method of stimulating a hydrocarbon-containing formation intermediate to the lengths of two parallel wellbores situated in said formation, comprising the steps of:

(i) placing within a first of said wellbores, at a plurality of discrete intervals along a length thereof, a fluid pressurization means which allows for supply of a pressurized fluid at each of said discrete intervals;

(ii) applying, via said fluid pressurization means, said fluid at each of said discrete intervals, at a first pressure below formation fracturing pressure;

(iii) sensing, via sensing means, at discrete intervals along a second wellbore parallel to said first wellbore and corresponding to the discrete intervals along the first wellbore, a value indicative of ease of penetration of said fluid within a region of said formation proximate said discrete intervals along said first and second wellbores and thereby compiling a plurality of the values at associated discrete locations along said first and second wellbores;

(iv) comparing each of said values for each discrete interval along the second wellbore to the values for other discrete intervals along the second wellbore; and (v) applying cyclic fluid pressure pulses, at a second pressure above a formation fracturing pressure, within first or second of said wellbores at one or more of said discrete intervals along said wellbores which have associated values which indicate lack of ease of said fluid penetrating into said formation;

wherein said step of applying pressure pulses comprises use of the fluid pressurization means wherein said fluid pressurization means comprises:

a cylindrical elongate member, having an upstream end and a mutually-opposite downstream end;

a reservoir chamber, situated at said downstream end, said chamber bounded at an upstream end thereof by a slidable piston member;

a tubular passageway means, extending along at least a portion of a length of said elongate member, in fluid communication with said reservoir chamber and providing fluid communication between a fluid inlet at said upstream end and said reservoir chamber;

a fluid exit passage;

a valve member contacted by said tubular passageway means, having an open position and a closed position, for allowing and preventing fluid flow from said fluid inlet to said fluid exit passage; and a biasing means biasing said slidable piston member against fluid in said reservoir chamber and further biasing said tubular passageway means against said valve member so as to bias said valve member to said open position which allows fluid to exit said tool via said fluid exit passage;

wherein upon fluid being supplied to said fluid inlet at said upstream end and said valve member being in the closed position, fluid pressure in said reservoir chamber increases due to fluid supplied to said reservoir chamber from the fluid inlet via said tubular passageway means, and said slidable piston member is caused to move upstream against said biasing means and said biasing means then forces said tubular passageway means to move said valve member to said open position and allow fluid from said fluid inlet to exit the tool via said fluid exit passage, thereby causing a drop in fluid pressure in both said tubular passageway means and said reservoir chamber, thereby causing said sliding piston to move downstream in said reservoir chamber and allowing said valve member to move to the closed position.

3. A method for hydrocarbon recovery from a formation using first and second wellbores passing through the formation, the formation comprising regions, the first and second wellbores substantially parallel and adjacent to each other, the method comprising the steps of:

(i) applying to the first wellbore, via a fluid pressurization means, a pressurized fluid at each of a series of first discrete intervals along the first wellbore, at a first pressure below formation dilation pressure;

(ii) subsequent to application of the pressurized fluid at the first pressure, sensing, via sensing means situated within the second wellbore, at each of a series of second discrete intervals along the second wellbore each corresponding to one of the first discrete intervals, a value indicative of ease of penetration of the pressurized fluid into the region between the corresponding first and second discrete intervals;

(iii) assigning a threshold extent of penetration of the pressurized fluid into the regions, above which the value indicates the region manifesting ease of penetration of the pressurized fluid into the region between the corresponding first and second discrete intervals;

(iv) based on the assigned threshold and the sensed value for each of the regions, determining which of the regions manifest ease of penetration of the pressurized fluid;

(v) subsequent to determining which of the regions manifest ease of penetration of the pressurized fluid, applying to the first or second wellbore, via the fluid pressurization means, the pressurized fluid at each of the first or second discrete intervals corresponding to the regions not manifesting ease of penetration of the pressurized fluid, at a second pressure above the formation dilation pressure;

(vi) allowing the pressurized fluid at the second pressure to dilate the formation at only the regions not manifesting ease of penetration of the pressurized fluid; and (vii) producing hydrocarbon from the regions not manifesting ease of penetration of the pressurized fluid, through the first or second wellbore.

4. The method of claim 3 wherein the value is determined by, subsequent to application of the pressurized fluid at the first pressure, sensing, via the sensing means for each of the regions, a value indicative of a rate, volume or extent of penetration of the pressurized fluid into the region.

5. The method of claim 3 wherein the value is determined by:

(i) sensing a value indicative of a rate of pressure decline from a fixed initial pressure of said pressurized fluid supplied via said fluid pressurization means;

(ii) sensing a value indicative of a volume of pressurized fluid supplied via said fluid pressurization means during a given time interval;

(iii) sensing a value indicative of a quantum of pressure decline over a given time interval with respect to said pressurized fluid being supplied via said fluid pressurization means; or (iv) detecting the presence of said pressurized fluid.

6. The method of claim 3 wherein the pressurized fluid is applied at the second pressure in pressurized pulses.

7. The method of claim 3 wherein the pressurized fluid is applied at the second pressure in cyclic pressurized pulses.

8. The method of claim 3 wherein the pressurized fluid is applied at the first pressure in pressurized pulses.

9. The method of claim 3 wherein the sensing means comprise a fibre optic cable and multiplexing means to allow sensing of the values obtained for each of the regions.

10. A method for hydrocarbon recovery from a formation using first and second wellbores passing through the formation, the formation comprising hydrocarbon-dominant regions and water-dominant regions, the first and second wellbores substantially parallel and adjacent to each other, the method comprising the steps of:

(i) applying to the first wellbore, via a fluid pressurization means, a pressurized fluid at each of a series of first discrete intervals along the first wellbore, at a first pressure below formation dilation pressure;

(ii) subsequent to application of the pressurized fluid at the first pressure, sensing, via sensing means situated within the second wellbore, at each of a series of second discrete intervals along the second wellbore each corresponding to one of the first discrete intervals, a value indicative of ease of penetration of the pressurized fluid into the region between the corresponding first and second discrete intervals;

(iii) assigning a threshold extent of penetration of the pressurized fluid into the regions, above which the value indicates the region between the corresponding first and second discrete intervals being a water-dominant region, below which the value indicates the region between the corresponding first and second discrete intervals being a hydrocarbon-dominant region;

(iv) based on the assigned threshold and the sensed value for each of the regions, determining which of the regions are water-dominant regions;

(v) subsequent to determining which of the regions are water-dominant regions, inserting plugging means at each of the first or second discrete intervals corresponding to water-dominant regions in the wellbore selected for production of hydrocarbon;

(vi) subsequent to inserting the plugging means, applying to the wellbore not selected for production of the hydrocarbon, via the fluid pressurization means, the pressurized fluid at each of the first or second discrete intervals corresponding to the hydrocarbon-dominant regions, at a second pressure above the formation dilation pressure;

(vii) allowing the pressurized fluid at the second pressure to dilate the formation at only the hydrocarbon-dominant regions; and (viii) producing the hydrocarbon from the hydrocarbon-dominant regions, through the wellbore selected for production of the hydrocarbon.

11. The method of claim 10 wherein the value is determined by, subsequent to application of the pressurized fluid at the first pressure, sensing, via the sensing means for each of the regions, a value indicative of a rate, volume or extent of penetration of the pressurized fluid into the region.

12. The method of claim 10 wherein the value is determined by:

(i) sensing a value indicative of a rate of pressure decline from a fixed initial pressure of said pressurized fluid supplied via said fluid pressurization means;

(ii) sensing a value indicative of a volume of pressurized fluid supplied via said fluid pressurization means during a given time interval;

(iii) sensing a value indicative of a quantum of pressure decline over a given time interval with respect to said pressurized fluid being supplied via said fluid pressurization means; or (iv) detecting the presence of said pressurized fluid.

13. The method of claim 10 wherein the pressurized fluid is applied at the second pressure in pressurized pulses.

14. The method of claim 10 wherein the pressurized fluid is applied at the second pressure in cyclic pressurized pulses.

15. The method of claim 10 wherein the pressurized fluid is applied at the first pressure in pressurized pulses.

16. The method of claim 10 wherein the sensing means comprise a fibre optic cable and multiplexing means to allow sensing of the values obtained for each of the regions.

17. A method for hydrocarbon recovery from a formation using first and second wellbores passing through the formation, the formation having high-permeability regions and low-permeability regions, the low-permeability regions preferentially retaining hydrocarbon, the first and second wellbores substantially parallel and adjacent to each other, the method comprising the steps of:

(i) applying to the first wellbore, via fluid pressurization, a pressurized fluid at each of a series of first discrete intervals along the first wellbore, at a first pressure below formation dilation pressure;

(ii) subsequent to application of the pressurized fluid at the first pressure, sensing, via sensing means situated within the second wellbore, at each of a series of second discrete intervals along the second wellbore each corresponding to one of the first discrete intervals, a value indicative of ease of penetration of the pressurized fluid into the region between the corresponding first and second discrete intervals;

(iii) assigning a threshold extent of penetration of the pressurized fluid into the regions, below which the value indicates the region between the corresponding first and second discrete intervals being a low-permeability region;

(iv) based on the assigned threshold and the sensed value for each of the regions, determining which of the regions are low-permeability regions;

(v) subsequent to determining which regions along the first wellbore are low-permeability regions, applying to the first or second wellbore, via the fluid pressurization means, the pressurized fluid at each of the first or second discrete intervals corresponding to the low-permeability regions, at a second pressure above the formation dilation pressure;

(vi) allowing the pressurized fluid at the second pressure to dilate the formation at only the low-permeability regions to create dilated target regions; and (vii) producing hydrocarbon from the dilated target regions, through the second or first wellbore, respectively.

18. The method of claim 17 wherein the value indicative of ease of penetration of the pressurized fluid is determined by, subsequent to application of the pressurized fluid at the first pressure, sensing, via the sensing means for each of the regions, a value indicative of a rate, volume or extent of penetration of the pressurized fluid into the region.

19. The method of claim 17 wherein the value indicative of ease of penetration of the pressurized fluid is determined by, subsequent to application of the pressurized fluid at the first pressure, sensing, via the sensing means for each of the regions, a value indicative of a rate, volume or extent of penetration of the pressurized fluid into the region.

20. The method of claim 17 wherein the value indicative of ease of penetration of the pressurized fluid is determined by:

(i) sensing a value indicative of a rate of pressure decline from a fixed initial pressure of said pressurized fluid supplied via said fluid pressurization means;

(ii) sensing a value indicative of a volume of pressurized fluid supplied via said fluid pressurization means during a given time interval;

(iii) sensing a value indicative of a quantum of pressure decline over a given time interval with respect to said pressurized fluid being supplied via said fluid pressurization means; or (iv) detecting the presence of said pressurized fluid.

21. The method of claim 17 wherein the pressurized fluid is applied at the second pressure in pressurized pulses.

22. The method of claim 17 wherein the pressurized fluid is applied at the second pressure in cyclic pressurized pulses.

23. The method of claim 17 wherein the pressurized fluid is applied at the first pressure in pressurized pulses.

24. The method of claim 17 wherein the sensing means comprise a fibre optic cable and multiplexing means to allow sensing of the values obtained for each of the regions.

* * * * *